US008940135B2

(12) United States Patent
Skupin et al.

(10) Patent No.: US 8,940,135 B2
(45) Date of Patent: Jan. 27, 2015

(54) PRODUCTION OF FILLED PAPER USING BIODEGRADABLE POLYESTER FIBERS AND/OR POLYALKYLENE CARBONATE FIBERS

(71) Applicant: BASF SE, Ludwigshafen (DE)

(72) Inventors: Gabriel Skupin, Speyer (DE); Rainer Blum, Limburgerhof (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/689,093

(22) Filed: Nov. 29, 2012

(65) Prior Publication Data

US 2013/0139983 A1 Jun. 6, 2013

Related U.S. Application Data

(60) Provisional application No. 61/565,518, filed on Dec. 1, 2011.

(51) Int. Cl.

| | |
|---|---|
| ***D21H 13/00*** | (2006.01) |
| ***D21H 13/24*** | (2006.01) |
| ***D21H 23/00*** | (2006.01) |
| ***D21H 23/04*** | (2006.01) |
| ***D21H 13/14*** | (2006.01) |
| ***D21H 15/02*** | (2006.01) |

(52) U.S. Cl.

CPC ..... *D21H 23/00* (2013.01); *D21H 13/14* (2013.01); *D21H 13/24* (2013.01); *D21H 15/02* (2013.01)

USPC ..... 162/157.3; 162/141; 162/157.2; 162/181.1; 428/221; 428/364; 428/401

(58) Field of Classification Search

USPC ..... 162/141, 146, 157.1, 157.2, 157.3, 158, 162/181.1–181.8; 428/221, 292.1, 311.51, 428/364, 392, 394, 395, 401, 480

See application file for complete search history.

(56) References Cited

U.S. PATENT DOCUMENTS

| | | | | |
|---|---|---|---|---|
| 4,789,727 | A | 12/1988 | Sun | |
| 5,171,308 | A * | 12/1992 | Gallagher et al. | 604/365 |
| 5,905,046 | A | 5/1999 | Takeda et al. | |
| 6,103,858 | A | 8/2000 | Yamamoto et al. | |
| 6,824,844 | B1 * | 11/2004 | Kondo et al. | 428/32.37 |
| 7,304,172 | B2 | 12/2007 | Coates et al. | |
| 7,790,640 | B2 * | 9/2010 | Chakravarty et al. | 442/335 |
| 7,967,952 | B2 * | 6/2011 | Williams et al. | 162/146 |
| 2011/0187029 | A1 | 8/2011 | Dietrich et al. | |
| 2012/0276619 | A1 | 11/2012 | Yamamoto et al. | |

FOREIGN PATENT DOCUMENTS

| | | | |
|---|---|---|---|
| DE | 41 21 085 | A1 | 1/1992 |
| DE | 196 38 686 | A1 | 3/1998 |
| DE | 199 31 402 | A1 | 1/2001 |
| DE | 10 2005 053 068 | A1 | 5/2007 |
| EP | 0 801 172 | A1 | 10/1997 |
| EP | 1 264 860 | A1 | 12/2002 |
| EP | 1 656 423 | | 5/2006 |
| EP | 1 838 784 | | 10/2007 |
| WO | WO 92/09654 | A2 | 6/1992 |
| WO | WO 93/07198 | A1 | 4/1993 |
| WO | WO 96/15173 | A1 | 5/1996 |
| WO | WO 96/15176 | A1 | 5/1996 |
| WO | WO 96/21689 | A2 | 7/1996 |
| WO | WO 96/21692 | A1 | 7/1996 |
| WO | WO 96/25446 | A1 | 8/1996 |
| WO | WO 96/25448 | A1 | 8/1996 |
| WO | WO 98/12242 | A1 | 3/1998 |
| WO | WO 2005/017034 | A1 | 2/2005 |
| WO | WO 2005/063886 | A1 | 7/2005 |
| WO | WO 2006/057353 | A1 | 6/2006 |
| WO | WO 2006/057354 | A1 | 6/2006 |
| WO | WO 2006/074815 | A1 | 7/2006 |
| WO | WO 2006/097353 | A1 | 9/2006 |
| WO | WO 2006/097354 | A1 | 9/2006 |
| WO | WO 2006/120700 | A2 | 11/2006 |
| WO | WO 2007/125039 | A1 | 11/2007 |
| WO | WO 2008/140384 | A1 | 11/2008 |
| WO | WO 2010/034710 | A1 | 4/2010 |
| WO | WO 2010/034711 | A1 | 4/2010 |
| WO | WO 2010/034712 | A1 | 4/2010 |
| WO | WO 2011/054694 | A1 | 5/2011 |
| WO | WO 2011/073265 | A1 | 6/2011 |
| WO | WO 2012/168398 | A1 | 12/2012 |

OTHER PUBLICATIONS

"Choosing the Proper Short Cut Fiber for Your Nonwoven Web", technical data sheet, MiniFibers, Inc., [online] pp. 1-2, 2008 (as determined using the Internet Archive Wayback Machine, URL: http://archive.org/web/web.php), [retrieved on Oct. 17, 2013],Retrieved from the Internet: <URL: http://www.minifibers.com/literature/choosing_fiber.pdf>.*

J. Peel, Paper Science & Paper Manufacture 1999, p. 90.*

Smook, Gary A., Handbook for Pulp and Paper Technologists, 2nd ed, Angus Wilde Publications, 1992, p. 220.*

International Search Report issued Jul. 11, 2013, in PCT/EP2012/073218 filed Nov. 21, 2012 with English translation of category of cited documents.

* cited by examiner

*Primary Examiner* — Dennis Cordray

(74) *Attorney, Agent, or Firm* — Oblon, Spivak, McClelland, Maier & Neustadt, L.L.P.

(57) ABSTRACT

The present invention relates to a process for producing filled paper, card and board comprising dewatering a paper stock with sheet formation and drying, wherein biodegradable polyester fibers and/or polyalkylene carbonate fibers are added to the paper stock.

36 Claims, No Drawings

PRODUCTION OF FILLED PAPER USING BIODEGRADABLE POLYESTER FIBERS AND/OR POLYALKYLENE CARBONATE FIBERS

The present invention relates to a process for producing filled paper, card and board comprising dewatering a paper stock with sheet formation and drying, wherein biodegradable polyester fibers and/or polyalkylene carbonate fibers are added to the paper stock.

There have been various developments in recent years to raise the filler content of papers. Filled papers make it possible to reduce the fibrous fraction and hence lead to reduced production costs. They further have the advantage of being easier to dry, which makes the papermaking process more economical.

However, increasing the filler content of paper also leads to changed paper properties such as reduced strengths. There have been attempts in the past to tackle this problem by using fillers modified with polymer solutions or dispersions.

Prior WO application PCT/EP2012/060847 teaches inorganic pigments coated with biodegradable polyester polymer and/or polyalkylene carbonate polymer, which are used as fillers in the papermaking process.

PCT/EP 2010/066079 teaches a process for sizing paper using biodegradable polymers as polymeric sizing agent. The biodegradable polymers in question are useful both as internal size and as surface size.

WO 2006/120700 teaches a process for producing high-strength paper by applying a polymeric film to the moist sheet of paper. Biodegradable polyesters such as Ecoflex® are recited among polymers said to be useful.

WO 2011/073265 and WO 2008/140384 teach a process for producing filter media wherein polylactic acid fiber and polyester fibers are mixed and the mixture is processed into filters via a carding process. Filter papers do not contain fillers.

DE 19931402 teaches filter materials composed of cellulose acetate fibers modified with biodegradable plasticizing substances such as polyester amides. The cellulose acetate fibers are mixed for this with the plasticizing substance. The filter papers are produced by applying the fibers thus blended atop a ply of natural fibers. The modified cellulose acetate fibers described therein are not biodegradable within the meaning of the EN 13432 standard.

It is an object of the present invention to provide a process for producing filled paper, card and board whereby paper, card or board basis weight is reduced while keeping the other properties, the strength in particular, the same. Furthermore, the paper-based products shall have a high filler content coupled with good strength and unchanged or improved paper machine efficiency.

We have found that this object is achieved by a process for producing filled paper, card and board comprising dewatering a paper stock with sheet formation and drying, wherein biodegradable polyester fibers and/or polyalkylene carbonate fibers are added to the paper stock.

The present invention comprises no filter papers. Filter paper is understood by a person skilled in the art to refer to filler-free, unfilled papers. These have sufficiently large pores to separate the suspended particles from the liquid.

It was found that the use of biodegradable fibers in the papermaking process not only leads to good paper properties but also additionally provides an advantage in paper sheet formation. It is believed that the crosslinking which takes place at sheet formation, between the fibers used according to the present invention and the cellulose fibers, leads to partial or complete fusion in the subsequent drying process and calendering process and thereby provides additional strength.

Polyester fibers and/or polyalkylene carbonate fibers hereinbelow are bodies whose length (longest dimension) is a multiple of their diameter. The length to diameter ratio by the definition of fiber is ≥5, preferably ≥100 and especially ≥2000. The fiber diameter is generally in the range from 3 to 100 μm. Owing to their low diameter, fibers are typically also defined in terms of linear density. It is preferable to use fibers having a linear density in the range from 0.1 to 100 dtex and especially from 1 to 20 dtex (10 μm-45 μm). dtex is the weight in grams of a fiber 10 km in length. Fibers are preferably used in lengths from 0.5 to 20 mm and preferably from 1 to 10 mm. Shorter fibers are possible in principle, since they also have a strengthening effect. Longer fibers similarly have no adverse effect on the papers obtained, but they may be more difficult to dose into the paper stock. Fibers having a length in the preferred range from 0.5 to 20 mm have the additional advantage that they are very useful for sheet formation.

Reference hereinbelow to biodegradable polyester fibers and/or polyalkylene carbonate fibers is to be understood as meaning biodegradable polyester fibers and/or biodegradable polyalkylene carbonate fibers.

Paper stock hereinafter refers to a mixture of water and fiber, this mixture additionally comprising filler and optionally paper auxiliaries, depending on the stage in the manufacturing process of the paper, board or card.

By dry content of paper is meant the solids content of paper, board and fiber using the thermal cabinet method of DIN EN ISO 638 DE.

For the purposes of this invention, the term pigment is used interchangeably with the term filler, since pigments are used as fillers in the production of paper. Filler is to be understood in the customary sense of paper production as meaning an inorganic pigment.

The "biodegradable" feature shall for the purposes of the present invention be considered satisfied for any one material or composition of matter when this material or composition of matter has a DIN EN 13432 chapter A.2 percentage degree of biodegradation equal to at least 90% of a suitable reference substance (e.g., microcrystalline cellulose).

The general effect of biodegradability is that the polymers and polymer mixtures (also referred to hereinbelow as polymer (mixtures) for short) decompose within an appropriate and verifiable interval. Degradation may be effected enzymatically, hydrolytically, oxidatively and/or through action of electromagnetic radiation, for example UV radiation, and may be predominantly due to the action of microorganisms such as bacteria, yeasts, fungi and algae. Biodegradability can be quantified for example by polymer (mixtures) being mixed with compost and stored for a certain time. According to DIN EN 13432 (ISO 14855), for example, $CO_2$-free air is flowed through ripened compost during composting and this treated compost subjected to a defined temperature program. Aerobic biodegradability here is defined via the ratio of the net $CO_2$ released by the sample (after deduction of the $CO_2$ released by the compost without sample) to the maximum amount of $CO_2$ releasable via the sample (reckoned from the carbon content of the sample), as a percentage degree of biodegradation. Biodegradable polymer (mixtures) typically show clear signs of degradation, such as fungal growth, cracking and holing, after just a few days of composting.

Other methods of determining biodegradability are described for example in ASTM D 5338 and ASTM D 6400-4.

Biodegradable polymers are already known to a person skilled in the art and are disclosed inter alia in Ullmann's Encyclopedia of Industrial Chemistry (online version 2009), Polymers, Biodegradable, Wiley-VCH Verlag GmbH & Co. KG, Weinheim, 2009, pages 131. More particularly, biodegradable polyester polymers for the purposes of the present invention shall subsume biodegradable aliphatic-aromatic polyesters as described in WO 2010/034712.

Biodegradable polyester fibers are preferably aliphatic polyesters or aliphatic-aromatic (partly aromatic) polyesters based on aliphatic and aromatic dicarboxylic acids and aliphatic dihydroxy compounds.

The fiber materials used according to the present invention are preferably polyalkylene carbonates and aliphatic or aliphatic-aromatic (partly aromatic) polyesters based on aliphatic and aromatic dicarboxylic acids and aliphatic dihydroxy compounds. These polymers may be present individually or in their mixtures.

Preferably, the biodegradable polyester polymer and/or polyalkylene carbonate polymer is water-insoluble.

In principle, all polyesters based on aliphatic and aromatic dicarboxylic acids and aliphatic dihydroxy compounds, so-called partly aromatic polyesters or aliphatic polyesters formed from aliphatic dicarboxylic acids and aliphatic diols or from aliphatic hydroxy carboxylic acids come into consideration for producing the biodegradable polyester mixtures. These polyesters are all biodegradable to DIN EN 13432. It will be appreciated that mixtures of two or more such polyesters are also suitable.

A preferable embodiment utilizes at least one aliphatic-aromatic polyester polymer.

Aliphatic-aromatic polyesters are polyesters based on aliphatic and aromatic dicarboxylic acids and aliphatic dihydroxy compounds, so-called partly aromatic polyesters. According to the present invention, this shall also subsume polyester derivatives such as polyether esters, polyester amides or polyether ester amides and polyester urethanes (see EP application No. 10171237.0). Suitable partly aromatic polyesters include linear polyesters which are not chain-extended (WO 92/09654). Chain-extended and/or branched partly aromatic polyesters are preferable. The latter are known from WO 96/15173 to 15176, 21689 to 21692, 25446, 25448 or WO 98/12242, which are hereby expressly incorporated herein by reference. Mixtures of different partly aromatic polyesters are similarly suitable. Interesting recent developments are based on renewable raw materials (see WO-A 2006/097353, WO-A 2006/097354 and WO 2010/034710). More particularly, partly aromatic polyesters include products such as Ecoflex® (BASF SE) and Eastar® Bio, Origo-Bi® (Novamont).

Particularly preferable partly aromatic polyesters include polyesters comprising as essential components A) an acid component composed of
  - a1) 30 to 99 mol % of at least one aliphatic dicarboxylic acid or its/their ester-forming derivatives or mixtures thereof,
  - a2) 1 to 70 mol % of at least one aromatic dicarboxylic acid or its/their ester-forming derivative or mixtures thereof, and B) at least one diol component selected from $C_2$- to $C_{12}$-alkanediols and C) at least one component selected from
  - c1) a compound having at least three groups capable of ester formation,
  - c2) a di- or polyisocyanate,
  - c3) a di- or polyepoxide.

Useful aliphatic dicarboxylic acids and their ester-forming derivatives (a1) are generally those having 2 to 18 carbon atoms, preferably 4 to 10 carbon atoms. They can be linear or branched. In principle, however, dicarboxylic acids having a larger number of carbon atoms, for example up to 30 carbon atoms, can also be used.

Examples are oxalic acid, malonic acid, succinic acid, 2-methylsuccinic acid, glutaric acid, 2-methylglutaric acid, 3-methylglutaric acid, α-ketoglutaric acid, adipic acid, pimelic acid, azelaic acid, sebacic acid, brassylic acid, fumaric acid, 2,2-dimethylglutaric acid, suberic acid, diglycolic acid, oxaloacetic acid, glutamic acid, aspartic acid, itaconic acid and maleic acid. The dicarboxylic acids or their ester-forming derivatives can be used singly or as a mixture of two or more thereof.

Preference is given to using succinic acid, adipic acid, azelaic acid, sebacic acid, brassylic acid or their respective ester-forming derivatives or mixtures thereof. Particular preference is given to using succinic acid, adipic acid, sebacic acid or their respective ester-forming derivatives or mixtures thereof. Succinic acid, azelaic acid, sebacic acid and brassylic acid also have the advantage of being obtainable from renewable raw materials.

Preference is given to the following aliphatic-aromatic polyesters: poly(butylene azealate-co-butylene terephthalate) (PBAzeT), poly(butylene brassylate-co-butylene terephthalate) (PBBrasT) and particularly preferably: poly (butylene adipate terephthalate) (PBAT), poly(butylene sebacate terephthalate) (PBSeT) or poly(butylene succinate terephthalate) (PBST).

Aromatic dicarboxylic acids or their ester-forming derivatives (a2) can be used singly or as mixture of two or more thereof. Particular preference is given to using terephthalic acid or its ester-forming derivatives such as dimethyl terephthalate.

In general, the diols (B) are selected from branched or linear alkanediols having 2 to 12 carbon atoms, preferably 4 to 6 carbon atoms, or cycloalkanediols having 5 to 10 carbon atoms.

Examples of suitable alkanediols are ethylene glycol, 1,2-propanediol, 1,3-propanediol, 1,2-butanediol, 1,4-butanediol, 1,5-pentanediol, 2,4-dimethyl-2-ethylhexane-1,3-diol, 2,2-dimethyl-1,3-propanediol, 2-ethyl-2-butyl-1,3-propanediol, 2-ethyl-2-isobutyl-1,3-propanediol, 2,2,4-trimethyl-1,6-hexanediol, especially ethylene glycol, 1,3-propanediol, 1,4-butanediol and 2,2-dimethyl-1,3-propanediol (neopentylglycol); cyclopentanediol, 1,4-cyclohexanediol, 1,2-cyclohexanedimethanol, 1,3-cyclohexanedimethanol, 1,4-cyclohexanedimethanol or 2,2,4,4-tetramethyl-1,3-cyclobutanediol. Particular preference is given to 1,4-butanediol, especially combined with adipic acid as component a1), and 1,3-propanediol, especially combined with sebacic acid as component a1). 1,3-Propanediol also has the advantage of being available as a renewable raw material. Mixtures of different alkanediols can also be used.

Preferably partly aromatic polyesters are characterized by a molecular weight (Mn) in the range from 1000 to 100 000, especially in the range from 9000 to 75 000 g/mol, preferably in the range from 10 000 to 50 000 g/mol and a melting point in the range from 60 to 170° C. and preferably in the range from 80 to 150° C.

By polyesters formed from aliphatic dicarboxylic acids and aliphatic diols are meant polyesters formed from aliphatic diols and aliphatic dicarboxylic acids such as polybutylene succinate (PBS), polybutylene adipate (PBA), polyethylene adipate (PEA), polybutylene succinate adipate (PBSA), polybutylene succinate sebacate (PBSSe), polybutylene sebacate (PBSe) and polyethylene sebacate (PESe). Aliphatic polyesters are preferably polybutylene succinate (PBS), polybutylene succinate adipate (PBSA), polybutylene succinate sebacate (PBSSe) and polybutylene sebacate (PBSe). Aliphatic polyesters are marketed for example by Showa Highpolymers under the name of Bionolle and by Mitsubishi under the name of GSPIa. More recent developments are described in WO2010/034711.

Biodegradable polyesters, in addition to or in place of the aforementioned aliphatic and aliphatic/aromatic polyesters, may comprise further polyesters such as, for example, polylactic acid, polybutylene succinates, poly(butylene succinate-co-adipate)s, polyhydroxyalkanoates, polyester amides, polyalkylene carbonate, polycaprolactone. Especially polylactic acid and polycaprolactone and polyhydroxyalkanoates must be mentioned as polyesters based on aliphatic hydroxy carboxylic acids. Preferred components in the polymer mixtures or else as straight components are polylactic acid (PLA), polybutylene succinates, poly(butylene succinate-co-adipate)s and polyhydroxyalkanoates, and of these especially polyhydroxybutyrate (PHB) and poly(hydroxybutyrate co-hydroxyvalerate) (PHBV) and poly(hydroxybutyrate-co-hydroxyhexanoate)s (PHBH).

In one preferred embodiment, an aliphatic polyester is used in admixture with polylactic acid. Preference is given to using a mixture consisting of:

5 to 50 wt % of polybutylene adipate terephthalate (PBAT), polybutylene sebacate terephthalate (PBSeT) polybutylene succinate (PBS), polybutylene succinate adipate (PBSA) and/or polybutylene succinate sebacate (PBSSe), and 50 to 95 wt % of polylactic acid.

In one particularly preferred embodiment, polybutylene adipate terephthalate is used in admixture with polylactic acid.

Particular preference is given to using a mixture consisting of 5 to 50 wt % of polybutylene adipate terephthalate (PBAT), 50 to 95 wt % of polylactic acid, and 0 to 5 wt % of polybutylene succinate (PBS) and/or polybutylene succinate adipate (PBSA).

Polylactic acid having the following profile of properties is used with preference:

a melt volume rate (MVR at 190° C. and 2.16 kg to ISO 1133) of 0.5—preferably 2—to 30, especially 20 ml/10 minutes a melting point below 240° C.;

a glass transition point (Tg) above 55° C.

a water content of below 1000 ppm a residual monomer content (lactide) of below 0.3%.

a molecular weight of above 80 000 daltons.

Preferred polylactic acids are for example NatureWorks® 6201 D, 6202 D, 6251 D, 3051 D and especially 3251 D, 4032 D, 4043 D or 4044 D (polylactic acid from NatureWorks).

Biodegradable polyhydroxyalkanoates are primarily poly-4-hydroxybutyrates and poly-3-hydroxybutyrates, but further comprise copolyesters of the aforementioned hydroxybutyrates with 3-hydroxyvalerates (P(3HB)-co-P(3HV)) or 3-hydroxyhexanoate. Poly-3-hydroxybutyrate-co-4-hydroxybutyrates (P(3HB)-co-P(4HB)) are known from Metabolix in particular. They are marketed under the trade name of Mirel®. Poly-3-hydroxybutyrate-co-3-hydroxyhexanoates (P(3HB)-co-P(3HH)) are known from P&G or Kaneka. Poly-3-hydroxybutyrates are marketed for example by PHB Industrial under the trade name of Biocycle® and by Tianan under the name of Enmat®.

The molecular weight $M_w$ of the polyhydroxyalkanoates is generally in the range from 100 000 to 1 000 000 and preferably in the range from 300 000 to 600 000.

Polycaprolactone is marketed, for example, by Daicel under the product name of Placcel®.

Preferable polyester mixtures of partly aromatic polyesters and polylactic acid or polyhydroxyalkanoates are described in EP 1656 423, EP 1838784, WO 2005/063886, WO 2006/057353, WO 2006/057354, WO 2010/034710 and WO 2010/034712.

Biodegradable polyalkylene carbonates primarily comprise polyethylene carbonate (see EP-A 1264860), obtainable by copolymerization of ethylene oxide and carbon dioxide and especially polypropylene carbonate (see for example WO 2007/125039) obtainable by copolymerization of propylene oxide and carbon dioxide.

The polyalkylene carbonate chain may comprise ether groups as well as carbonate groups. The proportion of carbonate groups in the polymer depends on the reaction conditions such as particularly the catalyst used. In preferable polyalkylene carbonates more than 85 and preferably more than 90% of all linkages are carbonate groups. Suitable zinc and cobalt catalysts are described in U.S. Pat. No. 4,789,727 and U.S. Pat. No. 7,304,172. Polypropylene carbonate is further obtainable similarly to Soga et al., Polymer Journal, 1981, 13, 407-10. The polymer is also commercially available, for example from Empower Materials Inc. or Aldrich.

At workup of polyalkylene carbonates, it is particularly important that the catalyst be removed as quantitatively as possible. For this, the general practice is to dilute the reaction mixture with a polar aprotic solvent such as, for example, a carboxylic ester (especially ethyl acetate), a ketone (especially acetone), an ether (especially tetrahydrofuran) to 2 to 10 times the volume. Subsequently, the reaction mixture is admixed with an acid such as acetic acid and/or an acid anhydride such as acetic anhydride and stirred for several hours at slightly elevated temperature. The organic phase is washed and separated. The solvent is preferably distilled off under reduced pressure and the residue dried.

The molecular weight Mn of polypropylene carbonates obtained by the abovementioned processes is generally in the range from 70 000 to 90 000 Da. The molecular weight Mw is typically in the range from 250 000 to 400 000 Da. The ratio of ether to carbonate groups in the polymer is in the range from 5:100 to 90:100. For improved performance characteristics, it can be advantageous to treat the polyalkylene carbonates with MA (maleic anhydride), acetic anhydride, di- or polyisocyanates, di- or polyoxazolines or -oxazines or di- or polyepoxides. Polypropylene carbonates having a molecular weight Mn of 30 000 to 5 000 000, preferably 35 000 to 250 000 and more preferably 40 000 to 150 000 Da are obtainable in this way. Polypropylene carbonates having an Mn of below 25 000 Da have a low glass transition temperature of below 25° C. Therefore, they have but limited usefulness for surface applications (e.g., coating) with the pigments mentioned. Polydispersity (ratio of weight average (Mw) to number average (Mn)) is generally between 1 and 80 and preferably between 2 and 10. The polypropylene carbonates used may comprise up to 1% of carbamate and urea groups.

Useful chain extenders for polyalkylene carbonates are especially MA (maleic anhydride), acetic anhydride, di- or polyisocyanates, di- or polyoxazolines or -oxazines or di- or polyepoxides. Examples of isocyanates are tolylene 2,4-diisocyanate, tolylene 2,6-diisocyanate, 2,2'-diphenylmethane diisocyanate, 2,4'-diphenylmethane diisocyanate, 4,4'-diphenylmethane diisocyanate, naphthylene 1,5-diisocyanate or xylylene diisocyanate and especially 1,6-hexamethylene diisocyanate, isophorone diisocyanate or methylenebis(4-isocyanatocyclohexane). Isophorone diisocyanate and especially 1,6-hexamethylene diisocyanate are particularly preferable aliphatic diisocyanates. As bisoxazolines there may be mentioned 2,2'-bis(2-oxazoline), bis(2-oxazolinyl)methane, 1,2-bis(2-oxazolinyl)ethane, 1,3-bis(2-oxazolinyl)propane or 1,4-bis(2-oxazolinyl)butane, especially 1,4-bis(2-oxazolinyl)benzene, 1,2-bis(2-oxazolinyl)benzene or 1,3-bis(2-oxazolinyl)benzene. The amounts in which chain extenders are used are preferably in the range from 0.01 to 5, more preferably in the range from 0.05 to 2 and even more preferably in the range from 0.08 to 1 wt %, based on the polymer quantity.

The biodegradable polyester and/or polyalkylene carbonate may further comprise additives. Possible additives include those typical in plastics technology: nucleating agents such as, for example, polybutylene terephthalate (PBT) in the case of copolyesters of PBT (e.g., PBAT, PBSeT, PBST), polybutylene succinate in the case of polylactic acid; slip and release agents such as stearates (especially zinc stearate, tin stearate and calcium stearate); plasticizers such as, for example, citric esters (especially tributyl citrate and tributyl acetylcitrate), glyceric esters such as triacetyl glycerol or ethylene glycol derivatives; surfactants such as polysorbates, palmitates or laurates; waxes such as, for example, carnauba wax, candelilla wax, beeswax or beeswax ester, jojoba oil, japan wax, spermaceti, lanolin; UV absorber (e.g., hydroquinones); UV stabilizers; antifog agents (e.g., polysorbates) or dyes. Additives are used in concentrations of 0 to 5 wt % and especially 0.1 to 2 wt % based on the biodegradable polyester and/or polyalkylene carbonate. Plasticizers may be present in 0.1 to 30 wt % (preferably: 0.1 to 10 wt %) based on the biodegradable polyester and/or polyalkylene carbonate.

Production of Fibers

The fibers used according to the present invention are obtainable for example via a melt-spinning process (Franz Fourné, "Synthetische Fasern" Carl Hanser Verlag, 1995, p. 271 ff). The polymer (i.e., the particular polyester or polyalkylene carbonate) or the compound (i.e., the abovementioned polymer mixtures) is melted, and homogenized, in a single-screw extruder having a smooth, fluted or grooved barrel. Following the metering zone, the melt is cleaned using a melt filter. The polymer melt is forced through one or more dies, cooled down in a quench shaft in a defined manner, spin finished and wound up. When only one die of usually comparatively large diameter is used, the product is a so-called monofil, while two or more dies produce a multifilament. Multifilaments of 12 to 200 or even >200 monofils are typical and are hereinbelow referred to as yarns. The dies have a diameter of typically 200 to 500 μm. The monofils and multifilaments (yarns) are treated with a spin finish which typically comprises mineral oils or vegetable oils as a lubricant, which are dispersed in water. The spin finish serves to avoid surface damage due to friction at the yarn guides which may occur at the high linear speeds of 1000 to 6000 m/min. The spin finish is applied to the yarn as a rod or pin spin finish: Via a defined slot or a drilled hole in a ceramic yarn guide, the spin finish is continuously gear-pumped and wets the fiber surfaces. The yarn is hauled off by a driven delivery roll and subsequently stabilized over two or more godets which provide positive-feedback control of the yarn tension via speed differences. The yarn is also drawn in a ratio of 1.1:1 to 2:1 via speed differences and godet temperature control. Subsequently, the yarn is wound up on bobbins by a high-performance winder.

A stable melt-spinning process requires appropriate flow behavior on the part of the molten polymer/compound. The polymers used generally have a predominantly linear construction and may only have a molecular weight within a certain range, which is usually set in the polymer production stage via the melt volume rate (MVR) of ISO 1133. Polymers processed have an MVR of 5 to 50 ml/10 min, preferably of 12 to 35 ml/10 min and more preferably of 15 to 30 ml/10 min at the particular melt temperature. All the while, a residual moisture content <800 ppm preferably <500 ppm more preferably <200 ppm must generally be observed in order that any hydrolysis during processing may be minimized.

As the fiber is wound up after emerging from the die, the polymer chains become partly oriented in the fiber direction. As the polymer solidifies on cooling, amorphous and crystalline sub-regions form in the fiber. The ratio of amorphous and crystalline regions and the crystal structures formed are strongly dependent on the polymer and the haul-off speed. Increasing haul-off speed (typically in the range of 1000-6000 m/min) will improve the orientation of the polymer chains. Without secondary drawing, the product obtained is LOY (low oriented yarn) and also, given appropriate godet management, POY (partially oriented yarn). HOY (high oriented yarn) is only achieved via secondary drawing (Franz Fourné, "Synthetische Fasern" Carl Hanser Verlag, 1995, pp. 417 to 459)

It is additionally possible to mix not only an individual polymer but also two or more polymers in one filament of defined geometry simultaneously with the spinning operation, typically using a so-called bicomponent melt-spinning process.

The fibers, according to Franz Fourné, "Synthetische Fasern" Carl Hanser Verlag, 1995, pp. 460 to 489, are either converged into tows and cut using fiber-cutting machines such as, for example, Gru-Gru or Lummus cutters or a Neumag fiber cutter. Fiber length can be controlled via cut geometry and the process parameters. Heat removal in the cutting operation is decisive for the utility of the equipment without welding the polymers together.

A particular mention must be made in this connection of additives that effect fiber polymer nucleation to amplify the known orientation-induced crystallization of polymers. From 0.05 to 10% preferably 0.05 to 0.2% of inorganic fillers such as calcium carbonate (PCC), talc, kaolin, mica. In the case of PLA, moreover, it is for example zinc phenylphosphonate, ethylenebisstearylamide, PBS, which act nucleatingly for example. In the case of PLLA having an L-lactic acid content of more than 99%, pure PDLA will also have a nucleating effect in small amounts (1 to 10%).

Useful additives for incorporation in polymers and compounds for fiber production further include:

- dyes such as titanium dioxide, iron oxides and organic dyes, preferably in amounts of 0.1 to 10% wt % based on the polymer/compound,
- lubricants such as fatty acid esters and fatty acid amides, preferably in amounts of 0.01 to 5% wt % based on the polymer/compound,
- plasticizers and dispersants such as triacetin, alkyl acetates, trialkyl citrates, alkanols and alkyl lactates, preferably in amounts of 0.5 to 20 wt % based on the polymer/compound,
- aroma chemicals such as linalool, geraniol and citral, preferably in amounts of 0.1 to 5 wt % based on the polymer/compound.

The polyester fiber and/or polyalkylene carbonate fibers can be used according to the present invention for producing any style of paper, for example newsprint, super-calendered (SC) paper, wood-free or wood-containing writing and printing papers and also coated styles of paper. Such papers are produced using as main raw material components for example groundwood, thermomechanical pulp (TMP), chemothermo-mechanical pulp (CTMP), pressure groundwood (PGW), bleached chemothermo-mechanical pulp (BCTMP) and also sulfite and sulfate pulp and wastepaper.

The biodegradable polyester fibers and/or polyalkylene carbonate fibers used according to the present invention can be used in the papermaking process not only in solid form but also in the form of a suspension. Aqueous suspensions of the polyester fibers and/or polyalkylene carbonate fibers are diluted to such an extent that they are readily flowable. Sufficient flowability is generally achieved with 0.05 to 20 wt % strength aqueous suspension of the biodegradable polyester fibers and/or polyalkylene carbonate fibers.

The amount in which the biodegradable polyester fibers and/or polyalkylene carbonate fibers is used based on the total stock (dry) which is fed to the head box of the paper machine is in the range from 0.3 to 40 wt % and especially in the range from 0.5 to 20 wt %.

The biodegradable polyester fibers and/or polyalkylene carbonate fibers are added according to the present invention to the paper stock at a fiber concentration in the range from 5 to 100 g/l. A fiber concentration of 20 to 100 g/l (which corresponds to a fiber concentration of 2 to 10 wt % based on the aqueous fibrous stuff) is usually understood in the paper production arts as referring to the thick stuff. Thin stuff is hereinbelow to be understood as having a fiber concentration in the range from 3 to 15 g/l. Subsequently, the total paper stock is diluted with water to a fiber concentration in the range from 5 to 15 g/l. Partial or complete addition of the biodegradable polyester fibers and/or polyalkylene carbonate fibers to the thin stuff is possible. However, addition to the thick stuff is preferable.

The fibers or, what is preferable, aqueous suspensions thereof are admixed to the cellulose fiber, or to a mixture of cellulose fiber and filler, in the papermaking process to form the total paper stock in this way. In addition to the fillers and fibers, the total stock may additionally comprise other conventional paper additives. Conventional paper additives are for example sizing agents, wet strength agents, cationic or anionic retention aids based on synthetic polymers, and also dual systems, drainage aids, other dry strength enhancers, inorganic pigments (fillers), optical brighteners, defoamers, biocides and paper dyes. These conventional paper additives can be used in the customary amounts.

Useful inorganic pigments (fillers) include any pigments based on metal oxides, silicates and/or carbonates which are typically useful in the paper industry, especially pigments from the group consisting of calcium carbonate, which can be used in the form of ground calcium carbonate (GCC), lime, chalk, marble or precipitated calcium carbonate (PCC), talc, kaolin, bentonite, satin white, calcium sulfate, barium sulfate and titanium dioxide. It is also possible to use mixtures of two or more pigments. Use is typically made of inorganic pigments having an average corpuscle size (Z-average) ≤10 μm, preferably in the range from 0.1 to 5 μm and especially in the range of to 0.1 to 4 μm. The average corpuscle size (Z-average) of the inorganic pigments as well as of the corpuscles of the pulverulent composition is generally determined herein by the method of quasi-elastic light scattering (DIN-ISO 13320-1) using for example a Mastersizer 2000 from Malvern Instruments Ltd.

Useful sizing agents include alkylketene dimers (AKDs), alkenylsuccinic anhydrides (ASAs) and resin size.

Useful retention aids include for example anionic microparticles (colloidal silica, bentonite), anionic polyacrylamides, cationic polyacrylamides, cationic starch, cationic polyethyleneimine or cationic polyvinylamine. Any combinations thereof are also conceivable, for example dual systems consisting of a cationic polymer with an anionic microparticle or an anionic polymer with a cationic microparticle. To achieve high retention of filler, it is advisable to add such retention aids, which can be added for example to the thick stuff but also to the thin stuff.

Dry strength enhancers are synthetic dry strength enhancers such as polyvinylamine or natural dry strength enhancers such as starch.

After sheet formation, the sheet of paper passes through the press section. The sheet is further dewatered there. And the dry content of the moist web of paper is increased by the pressure exerted in the press nip. The pressure can be varied over a relatively wide range in many paper machines. The press section is followed by the dryer section. This is where drying takes place and a bond is formed between the paper fiber and the polymer. Preference is given to a process wherein the sheet of paper is treated in the press section at temperatures in the range from 45 to 120° C. (cylinder temperature).

The process of the present invention is useful for producing filled paper, filled card and filled board. The respective filler content of paper, card and board can be in the range from 3 to 50 wt % based on the paper, card or board.

The process of the present invention is useful for producing filled papers such as graphic papers, packaging papers and also hygiene papers comprising recycled fibers.

In one preferred embodiment, a process for producing graphic paper is preferred. Graphic papers include papers such as wood-free papers, wood-free writing and printing papers, wood-containing writing and printing papers, and wood-free and wood-containing base papers for coating. Their filler content is generally in the range from 10 to 40 wt % based on the paper.

In a further preferred embodiment, a process for producing paper having a filler content of 10 to 20 wt % is preferred. Papers of this type are used particularly as packaging papers.

In a further preferred embodiment, a process for producing paper having a filler content of 5 to 25 wt % is preferred. Papers of this type are used particularly for newsprint.

In a further preferred embodiment, a process for producing paper having a filler content of 25 to 50 wt %, for example SC papers, is preferred.

The process of the present invention enables production of filled paper-based products of reduced basis weight coupled with unchanged strength. The biodegradable polyester fibers and/or polyalkylene carbonate fibers used according to the present invention in a process for producing paper and paper-based products enable production of paper having a higher filler content. The strength loss which is generally occasioned by the higher filler content is distinctly smaller compared with known processes of the prior art. The papers obtained according to the present invention display improved strengths as well as increased rupture resistance. This provides good printability (improved linting and dusting) combined with unchanged or improved paper machine efficiency.

The process further provides energy savings in the drying operation.

The examples which follow are nonlimiting and illustrate the invention.

EXAMPLES

1.) Analytical Method

Molecular weights $M_n$ and $M_w$ of partly aromatic polyesters were determined as follows:

15 mg of partly aromatic polyester were dissolved in 10 ml of hexafluoroisopropanol (HFIP). 125 μl at a time of this solution were analyzed using gel permeation chromatography (GPC). The measurements were carried out at room temperature. HFIP+0.05% by weight of potassium trifluoroacetate salt was used for elution. The elution rate was 0.5 ml/min. Column combination used was as follows (all columns from Showa Denko Ltd., Japan): Shodex® HFIP-800P (diameter 8 mm, length 5 cm), Shodex® HFIP-803 (diameter 8 mm, length 30 cm), Shodex® HFIP-803 (diameter 8 mm, length 30 cm). The partly aromatic polyesters were detected using an RI detector (differential refractometry). Narrowly distributed polymethyl methacrylate standards having molecular weights of $M_n$=505 to $M_n$=2 740 000 were used for calibration. Elution ranges outside this interval were determined by extrapolation.

Viscosity numbers were determined in accordance with DIN 53728 Part 3, Jan. 3, 1985, Capillary viscosity. An M-II type Micro-Ubbelohde was used. The solvent used was the 50/50 w/w phenol/dichlorobenzene mixture.

Melt volume-flow rate (MVR) was determined in line with EN ISO 1133. Test conditions were 190° C., 2.16 kg. Melting time was 4 minutes. MVR gives the rate of extrusion of a molten plastics molding through an extrusion die of defined length and defined diameter under prescribed conditions: temperature, loading and attitude of the piston. What is determined is the volume in the cylinder of an extrusion plastometer that is extruded within a defined period.

Biodegradable Polymers Used:

2.) Producing the Biodegradable Polymer Fibers

The tests were carried out using the commercial products Ecovio® FS Paper A1500 (BASF SE) and Bionolle® 1020.

Ecovio FS Paper A1500 has an MVR (190° C., 2.16 kg) of 23 ml/10 min and a residual moisture content of 190 ppm, determined using a Brabender Aquatrac Plus. Ecovio FS Paper A1500 comprises the aliphatic polyester polylactic acid with a melting point of 168° C. and the aliphatic/aromatic polyester Ecoflex® with a melting point of 110° C. The residual moisture content of Ecovio FS Paper A1500 is 600 ppm and the MVR (190° C., 2.16 kg) is 23 ml/10 min.

Bionolle 1020 has an MVR (190° C., 2.16 kg) of 20 ml/10 min and a residual moisture content of 380 ppm. The material is a polybutylene succinate from Showa Highpolymer, Japan.

Construction of Experimental Plant:

The experimental plant consisted of an extruder having a screw diameter of 30 mm. Screw length was 30 D. The extruder was only temperature controlled in the feed zone to 190° C. The remaining 3 heating zones of the extruder and the remaining heating zones from the sieve changer with 2 sieves of 40 μm mesh size to the spinneret pump were set to the desired melt temperature. Since the extruder was operated at the lower end of its performance capacity, heating of the melt due to dissipation was not observed. The spinneret pump having a specific feed volume of 4.0 $cm^3$/revolution was operated at a throughput of about 22 g/min. The die pack having a diameter of 115 mm consisted of 26 dies having a diameter of 300 μm. It was temperature controlled to the desired melt temperature. The quench shaft was about 1 m in length. The air throughput was adjusted to about 1 m/s in the central region. The spin finish was gear pumped and applied to the 26 filaments via a drilled hole in a yarn guide. The multifilament was hauled off via an unheated delivery roll and subsequently stabilized over 3 pairs of godets. The pairs of godets were unheated and had a speed difference of 10 m/min, which was microprocessor controlled. The multifilament was fed via a ceramic yarn guide without spin finish addition to the automatic winder (from Barmag), which was operated at a winding speed of 2500 m/min.

The multifilaments were plied on a reel into strands, which were wetted with cold water and fed in the moist state to a guillotine. Moistening the strands prevents overheating of the guillotine in cutting. The short fiber samples were produced in a length of 5 mm and subsequently dried at 40° C. for 8 h.

Example F1

Fiber Production with Ecovio FS Paper C1500

Fibers were produced from Ecovio FS Paper C1500 at a melt temperature of 210° C., at 22.5 g/min and at a spinneret pressure of 40 bar to produce a multifilament having a diameter of 18.5 μm for the individual filaments coupled with a linear density of 3.35 dtex. Fiber strengths are determined to ISO 2062 in tension using a Zwick Z005 tensile tester from Zwick/Roell GmbH. Coupled with 3650 MPa for a modulus of elasticity, a breaking extension of 43% and a tenacity of 16.8 cN/tex was measured.

Example F2

Fiber Production with Bionolle 1020

Fibers were produced from Bionolle 1020 at a melt temperature of 200° C., at 22.5 g/min and at a spinneret pressure of 33 bar to produce a multifilament having a diameter of 19.4 μm for the individual filaments coupled with a linear density of 3.71 dtex. Fiber strengths are determined to ISO 2062 in tension using a Zwick Z005 tensile tester from Zwick/Roell GmbH. Coupled with 940 MPa for a modulus of elasticity, a breaking extension of 193% and a tenacity of 16.3 cN/tex was measured.

The synthetic fibers were subjected to a laboratory disintegrator for about 15 min at a concentration of 1 to 6% in water to produce individual fibers at the end.

Producing the Paper Stock Suspension (Pulp)

The particular fiber combination and tap water were pulped in a laboratory pulper at a solids concentration of 4% until free of fiber bundles. (In the case of cellulosic pulp, the mixture was additionally beaten to a freeness of 30-35 SR.) The pH of the stuffs was in the range between 7 and 8. The beaten stuff was subsequently diluted with tap water to a solids concentration of 0.5% (5 g/l paper stock concentration).

Examples 1a, b, c

A bleached cellulosic pulp (100% eucalyptus pulp) paper stock was admixed with the Ecovio FS Paper fibers described in example F1 and calcium carbonate at 0 wt %, 1 wt % and 3 wt %. A sheet was formed therefrom with a grammage of 80 g/$m^2$ and a filler content of 23 weight percent.

The sheets of paper were each fabricated with a sheet weight of 80 g/$m^2$ on a Rapid-Köthen sheet-former to ISO 5269/2. The sheets were dried at 90° C. between two filter papers for 7 min. Thereafter they were calendered using a nip pressure of 300 N/cm. The pH of the paper stock suspension was in the range between 7 and 8. For sheet formation, a cationic polyacrylamide (Percol® 540) was added at 0.02 wt % based on the dry mass of paper.

Example 2a, b, c

A paper stock from deinked wastepaper was admixed with the Ecovio FS Paper fibers described in example F1 and calcium carbonate at 0 wt %, 1 wt % and 3 wt %. A sheet was formed therefrom with a grammage of 40 g/m$^2$ and a filler content of 18 weight percent.

The sheets of paper were each fabricated with a sheet weight of 40 g/m$^2$ on a Rapid-Köthen sheet-former to ISO 5269/2. The sheets were dried at 90° C. between two filter papers for 7 min. Thereafter they were calendered using a nip pressure of 300 N/cm. The pH of the paper stock suspension was in the range between 7 and 8. For sheet formation, a cationic polyacrylamide (Percol 540) was added at 0.02 wt % based on the dry mass of paper.

Example 3a, b, c

A paper stock from deinked wastepaper and groundwood was admixed with the Ecovio FS Paper fibers described in example F1 and calcium carbonate at 0 wt %, 1 wt % and 3 wt %. A sheet was formed therefrom with a grammage of 65 g/m$^2$ and a filler content of 14 weight percent.

The sheets of paper were each fabricated with a sheet weight of 65 g/m$^2$ on a Rapid-Köthen sheet-former to ISO 5269/2. The sheets were dried at 90° C. between two filter papers for 7 min. Thereafter they were calendered using a nip pressure of 300 N/cm. The pH of the paper stock suspension was in the range between 7 and 8. For sheet formation, a cationic polyacrylamide (Percol 540) was added at 0.02 wt % based on the dry mass of paper.

Testing the Sheets of Paper from Examples 1a, b, c, 2a, b, c and 3a, b, c

Following 12 hours of storage time in a conditioning chamber at a constant 23° C. and 50% relative humidity, the dry breaking length of the sheets was determined to DIN 54540 and the inner strength (Scott Bond) was determined to DIN 54516. The measurements were done with and without calendering. The calendering conditions were a nip pressure of 300 N/cm and 80° C. The results are summarized in Table 1.

TABLE 1

| Example | F1 fibers wt % | Dry breaking length, m | Scott Bond, N |
|---|---|---|---|
| 1a | none | 2089 | 91 |
| 1b | 1 | 2679 | 112 |
| 1c | 2 | 2802 | 118 |
| 2a | none | 2253 | 178 |
| 2b | 1 | 2810 | 221 |
| 2c | 3 | 2980 | 235 |
| 3a | none | 3388 | 192 |
| 3b | 1 | 4125 | 253 |
| 3c | 3 | 4252 | 261 |

The results show that a higher proportion of Ecovio FS Paper fibers causes paper stability to increase in that not only dry breaking lengths but also the Scott Bond value increase.

Example 4

This example utilized fibers from example F2 (Bionolle 1020) based on PBS (polybutylene succinate) and a packaging stock model.

A paper stock from 100% wastepaper was admixed with polyester fibers in certain proportions (Table 2).

A sheet was formed therefrom similarly to example 2 with a grammage of 75 g/m$^2$ and a filler content of 13 weight percent.

The sheets of paper were each fabricated with a sheet weight of 75 g/m$^2$ on a Rapid-Köthen sheet-former to ISO 5269/2. The sheets were dried at 90° C. between two filter papers for 7 min. There was no further calendering in this example.

The pH of the paper stock suspension was in the range between 7 and 8. For sheet formation, a cationic polyacrylamide (Percol 540) was added at 0.03 wt % based on the dry mass of paper.

Testing the Sheets of Paper from Example 4

Following 12 hours of storage time in a conditioning chamber at a constant 23° C. and 50% relative humidity, the dry breaking length of the sheets was determined to DIN 54540, the bursting pressure to DIN 2759 and the flat crush resistance to DIN 53143.

The results are summarized in Table 2.

TABLE 2

Results of performance testing of card of example 4

| Fibers of example F2 | Flat crush resistance N | Bursting pressure kPa | Dry breaking length m |
|---|---|---|---|
| none | 28 | 150 | 3946 |
| 0.3% wt % | 30 | 168 | 4289 |
| 0.9% wt % | 38 | 198 | 4646 |

The results show that as the proportion of polybutylene succinate fibers increases the stability of the board increases in that flat crush resistance, bursting pressure and dry breaking length all increase.

U.S. Provisional Application No. 61/565,518, filed on Dec. 1, 2011, is incorporated in the present application by literature reference.

We claim:

1. A process for producing filled paper, card, or board, the process comprising:

dewatering a paper stock with sheet formation and drying, wherein biodegradable polyester fibers and a filler are added to the paper stock, wherein the polyester fibers are at least one aliphatic polyester selected from the group consisting of polybutylene succinate (PBS), polybutylene succinate adipate (PBSA), polybutylene succinate sebacate (PBSSe) and polybutylene sebacate (PBSe), and wherein the filler content of the paper, card, or board is in the range from 10 to 50 wt %, based on the paper, card, or board.

2. The process of claim 1, wherein the biodegradable polyester fibers have a linear density in the range from 0.1 to 100 dtex.

3. The process of claim 1, wherein the biodegradable polyester fibers have a length from 0.5 to 20 mm.

4. The process of claim 1, wherein the biodegradable polyester fibers are water-insoluble biodegradable polyester.

5. The process of claim 1, wherein 0.3-40 wt % of biodegradable polyester fibers is added based on the dry paper.

6. The process of claim 1, wherein graphic papers are produced.

7. The process of claim 1, wherein packaging papers are produced.

8. The process of claim 1, wherein the paper, card and board is produced with a filler content of 10 to 25 wt %.

9. The process of claim 1, wherein the paper, card and board is produced with a filler content of 25 to 50 wt %.

10. A process for producing filled paper, card, or board, the process comprising:

dewatering a paper stock with sheet formation and drying, wherein biodegradable polyester fibers and/or polyalkylene carbonate fibers and a filler are added to the paper stock, wherein the filler content of the paper, card, or board is in the range from 10 to 50 wt %, based on the paper, card, or bard, and wherein the biodegradable polyester fibers are of a mixture consisting of:

from 5 to 50 wt % of at least one selected from the group consisting of polybutylene adipate terephthalate (PBAT), polybutylene sebacate terephthalate (PBSeT) polybutylene succinate (PBS), polybutylene succinate adipate (PBSA), and polybutylene succinate sebacate (PBSSe); and 50 to 95 wt % of polylactic acid.

11. The process of claim 10, wherein the biodegradable polyester fibers and/or polyalkylene carbonate fibers have a linear density in the range from 0.1 to 100 dtex.

12. The process of claim 10, wherein the biodegradable polyester fibers and/or polyalkylene carbonate fibers have a length from 0.5 to 20 mm.

13. The process of claim 10, wherein the biodegradable polyester fibers and/or polyalkylene carbonate fibers are at least one selected from the group consisting of a water-insoluble biodegradable polyester and polyalkylene carbonate.

14. The process of claim 10, wherein graphic papers are produced.

15. The process of claim 10, wherein packaging papers are produced.

16. The process of claim 10, wherein the paper, card and board is produced with a filler content of 10 to 25 wt %.

17. The process of claim 10, wherein the paper, card and board is produced with a filler content of 25 to 50 wt %.

18. A process for producing filled paper, card, or board, the process comprising:

dewatering a paper stock with sheet formation and drying, wherein biodegradable polyalkylene carbonate fibers and a filler are added to the paper stock, and wherein the filler content of the paper, card, or board is in the range from 10 to 50 wt %, based on the paper, card, or board.

19. The process of claim 18, wherein the biodegradable polyalkylene carbonate fibers consist of polypropylene carbonate.

20. The process of claim 18, wherein graphic papers are produced.

21. The process of claim 18, wherein packaging papers are produced.

22. The process of claim 18, wherein the paper, card and board is produced with a filler content of 10 to 25 wt %.

23. The process of claim 18, wherein the paper, card and board is produced with a filler content of 25 to 50 wt %.

24. A process for producing filled paper, card, or board, the process comprising:

dewatering a paper stock with sheet formation and drying, wherein biodegradable polyester fibers and polyalkylene carbonate fibers and a filler are added to the paper stock, and wherein the filler content of the paper, card, or board is in the range from 10 to 50 wt %, based on the paper, card, or board.

25. The process of claim 24, wherein the biodegradable polyalkylene carbonate fibers consist of polypropylene carbonate.

26. The process of claim 24, wherein the biodegradable polyester fibers are formed from at least one polyester comprising aliphatic and aromatic dicarboxylic acids with aliphatic dihydroxy compounds or aliphatic dicarboxylic acids with aliphatic dihydroxy compounds or from aliphatic hydroxy carboxylic acids.

27. The process of claim 24, wherein the polyester fibers are an aliphatic or aliphatic-aromatic polyester.

28. The process of claim 27, wherein the aliphatic-aromatic polyester fibers are present and have a melting point in the range from 80-150° C.

29. The process of claim 24, wherein polyester fibers are at least one aliphatic polyester selected from the group consisting of polybutylene succinate (PBS), polybutylene succinate adipate (PBSA), polybutylene succinate sebacate (PBSSe) and polybutylene sebacate (PBSe).

30. The process of claim 24, wherein the biodegradable polyester fibers and polyalkylene carbonate fibers have a linear density in the range from 0.1 to 100 dtex.

31. The process of claim 24, wherein the biodegradable polyester fibers and polyalkylene carbonate fibers have a length from 0.5 to 20 mm.

32. The process of claim 24, wherein the biodegradable polyester fibers and polyalkylene carbonate fibers are at least one selected from the group consisting of a water-insoluble biodegradable polyester and polyalkylene carbonate.

33. The process of claim 24, wherein graphic papers are produced.

34. The process of claim 24, wherein packaging papers are produced.

35. The process of claim 24, wherein the paper, card and board is produced with a filler content of 10 to 25 wt %.

36. The process of claim 24, wherein the paper, card and board is produced with a filler content of 25 to 50 wt %.

* * * * *